US006098541A

United States Patent [19]

Miyata

[11] Patent Number: 6,098,541

[45] Date of Patent: Aug. 8, 2000

[54] OVERPRINT STAMPER AND METHOD OF MAKING THE SAME

[75] Inventor: Hiroyasu Miyata, Tokyo, Japan

[73] Assignee: Alps Electric Co., Ltd., Japan

[21] Appl. No.: 09/271,787

[22] Filed: Mar. 18, 1999

[30] Foreign Application Priority Data

Mar. 18, 1998 [JP] Japan ..... 10-069089

[51] Int. Cl.[7] ..... B41F 1/04; B41F 31/00; B41K 1/38

[52] U.S. Cl. ..... 101/194; 101/327; 401/1

[58] Field of Search ..... 101/193–195, 101/287, 327, 333, 372, 373, 405; 401/1

[56] References Cited

U.S. PATENT DOCUMENTS

| | | | |
|---|---|---|---|
| 1,398,235 | 11/1921 | Linscott . | |
| 3,839,955 | 10/1974 | Klapholz | 101/334 |
| 4,683,821 | 8/1987 | Berberich | 101/170 |
| 5,049,432 | 9/1991 | Ooms et al. | 428/159 |
| 5,174,208 | 12/1992 | Fink et al. | 101/333 |
| 5,653,804 | 8/1997 | Yasoshima | 118/46 |

*Primary Examiner*—Kimberly Asher
*Attorney, Agent, or Firm*—Brinks Hofer Gilson & Lione

[57] ABSTRACT

An overprint stamper is provided with three print surface retainer portions positioned flush with each other in the non-depressed condition, print surface portions each comprising a thermoplastic expanded sheet fixed to each print surface retainer portion, a slider portion for supporting the print surface retainer portions rotatably by means of a resilient hinge means while being generally movable, and a guide bar for guiding the direction in which the slider portion moves. Further, in order to control the position where the slider portion stops so that each print surface portion is positioned at a predetermined printing position, three grooves are provided on the guide bar and a spring having a protrusion fitting therein is fixed to the slider portion.

4 Claims, 6 Drawing Sheets

OVERPRINT STAMPER AND METHOD OF MAKING THE SAME

BACKGROUND OF THE INVENTION

1. Field of the Invention

The present invention relates to an overprint stamper and a method of making same, and in particular, to the arrangement of a penetrant ink type stamper which allows multicolor printing by overprinting a plurality of different print surfaces on the same positions and a method of working the print surfaces.

2. Description of the Related Art

In general, stampers include two types: one that needs a stamper pad and a so-called penetrant ink type one that needs no pad. The penetrant ink type stamper is typically impregnated with single color ink, and even if one depresses its print surface for printing, single color letters or patterns are simply printed on the sheet. Therefore, if one uses the same penetrant ink type stamper and a plurality of print surfaces that are impregnated with various colors of ink are depressed at the same position, then it becomes possible to achieve a multicolor stamper or a full color stamper.

However, in the conventional stamper, in order to realize a color stamper which allows full color printing by using, for example, three print surfaces each having a different color, a high accuracy of printing positions has been necessary so that the permissible misregistrations of three color positions may fall within the range of, for example, 50 $\mu$m relative to each other. As a result, an inexpensive stamper allowing full color printing has not been achieved.

SUMMARY OF THE INVENTION

The present invention has been conceived in order to solve the foregoing problem, and its object is to provide an overprint stamper of simple construction, which nevertheless may improve the overprint accuracy to allow full color printing.

In order to solve the foregoing object, an overprint stamper according to the present invention is provided with a plurality of print surface retainer portions which each lie in flush with each other in the non-depressed state, a plurality of print surface portions each fixed to the plurality of print surface retainer portions, respectively, a slider portion for depressibly supporting the plurality of print surface retainer portions in juxtaposition while being generally movable in the direction in which the print surface retainer portions are juxtaposed, a guide portion for guiding the direction in which the slider portion moves, and a print position registering means for controlling the position on the guide portion where the slider portion stops so that each of the print surface portions may be positioned at a predetermined print position.

A method of making the overprint stamper according to the present invention comprises steps of preparing a plurality of print surfaces with a thermoplastic expanded sheet including open cells, each fixing the plurality of print surface portions to the plurality of print surface retainer portions, respectively, lying in the same plane, and then applying a print surface process to the plurality of print surface portions simultaneously by a heated deformation process.

In order to realize full color printing by overprinting, for example, three print surfaces each having a different color, it has been necessary to remove the cause of misregistration of three-color prints when overprinted. The inventors, as a result of review, have found that there are three major factors each causing the printing misregistration.

The first major factor relates to the misregistration of the patterns of print surfaces, which occur when the patterns are formed. The second major factor relates to positional misregistration, which occurs when the position of the print surface is determined for depression. The third major factor relates to pressure variation, which occurs when the print surfaces are pressed by the stamp.

Therefore, in the present invention, in order to remove these three causes, as a first step, three print surfaces are arranged to lie flush with each other so that they may be processed simultaneously with a view toward lessening the misregistration of the patterns of the print surfaces which occurs when the print surfaces are processed. Next, as a second step, the three print surfaces arranged flush with each other are supported by an arbitrary member (slider portion), and this slider portion is made to move in parallel to and along the guide portion to thereby improve the motion accuracy while a means for controlling the position where the slider portion stops on the guide portion is provided between the slider portion and the guide portion to thereby lessen the positional misregistration. Finally, as a third step, the three print surfaces are supported by the slider portion in a depressible manner so that the print surfaces may be moved relative to the slider portion with the latter fixed to thereby lessen their positional deviation due to the pressure.

To be more specific, a means for controlling the position where the slider portion stops on the guide portion (a means for registering the printing positions) may be arranged by providing a recess portion on the guide portion and providing a spring having a convex portion fitting with the recess portion on the slider portion. Thus, the registering accuracy of the print surfaces becomes substantially identical to the processing accuracy of the recess portion on the guide portion with the result that the misregistration of the print surfaces can be made as small as possible. Further, the slider portion and the print surface retainer portion may be integrally molded so that each print surface retainer portion is supported by means of a resilient hinge means so as to be rotatable relative to the slider portion within a plane perpendicular to the print surface.

Further, in the process of making the stamper according to the present invention, as described above, after the plurality of print surface portions are positioned flush with each other, they are simultaneously subjected to the heating deformation process. Since the heating deformation process allows the plurality of print surface patterns to be processed within an accuracy evaluated in terms of a single print surface pattern, the misregistration between the patterns of print patterns becomes extremely small thus resulting in a remarkably small printing misregistration.

Therefore, in the overprint stamper according to the present invention, the number of used parts may be small, and the number of points to be checked in regard to the working accuracy of each part may be lessened while, with a simple contraction, it becomes possible to overprint the plurality of print surfaces with high accuracy. As a result, an inexpensive color stamper, or a multicolor stamper can be realized.

DETAILED DESCRIPTION OF THE INVENTION

A specific embodiment of the present invention is described with reference to FIGS. 1 through 8.

Figure 1:
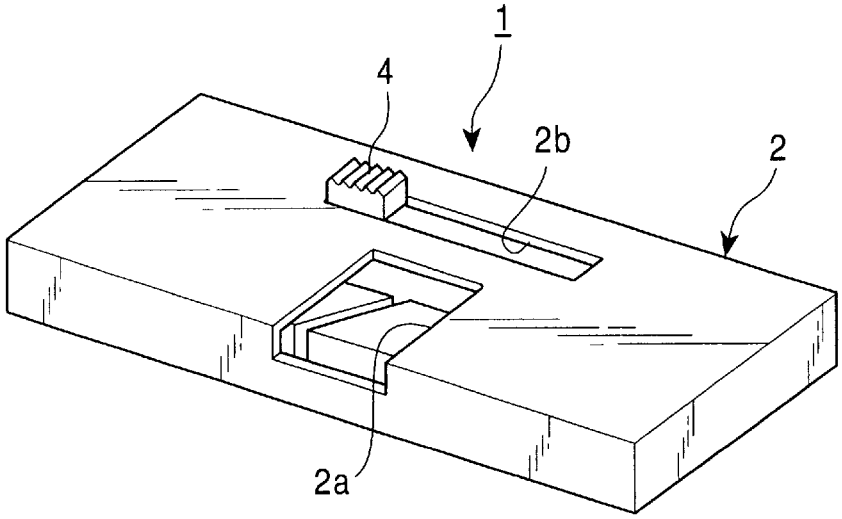
FIG. 1 is a perspective view of an overprint stamper according to a specific embodiment of the present invention.

The overprint stamper according to the present invention achieves full color by overprinting three print surfaces each having a different color. FIG. 1 is a perspective view illustrating an overprint stamper 1 according to this embodiment, FIG. 2 a top view and FIG. 3 a bottom view of the same.

Figure 2:
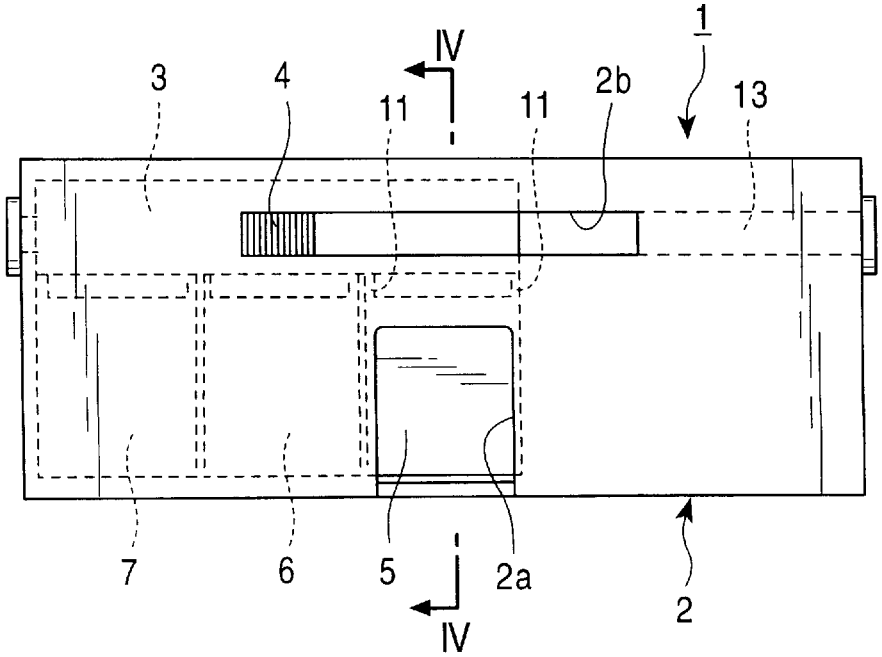
FIG. 2 is a top view of the overprint stamper according to the specific embodiment of the present invention.
Figure 3:
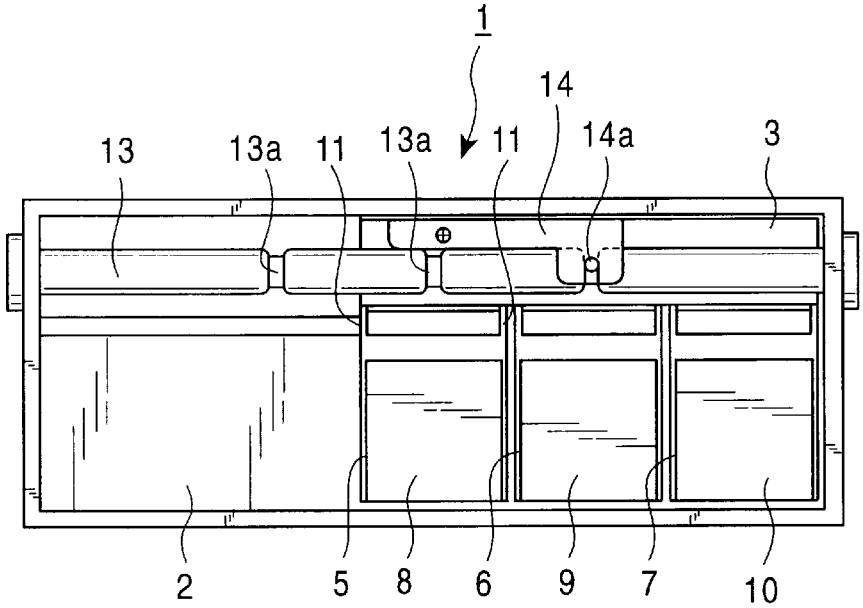
FIG. 3 is a bottom view of the overprint stamper according to the specific embodiment of the present invention.

As illustrated in FIGS. 1 through 3, reference numeral 2 denotes a frame of the stamper, within which various members constituting the major portions, such as, a guide bar, a slider portion, print surface retainer portions and the like are included. On this frame 2, a first rectangular window portion 2*a* and a second rectangular window portion 2*b* are formed each opening toward the upper surface thereof. The first window portion 2*a* is intended for depressing the print surface retainer portion by hand and the second window portion 2*b* for moving the knob on the slider portion.

Figure 4A:
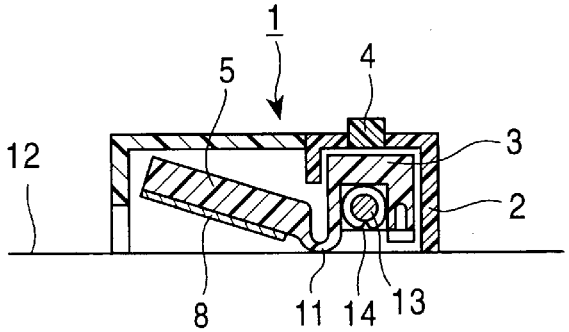
FIG. 4A is a cross-sectional view of the overprint stamper according to the specific embodiment of the present invention, taken along the line IV—IV.
Figure 4B:
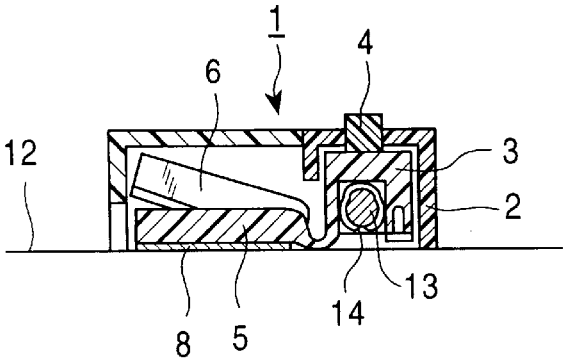
FIG. 4B is a view showing a pressed state of a printing surface holding portion of FIG. 4A.

As shown in FIG. 2, within the frame 2, an elongated box-shaped slider portion 3 the lower surface of which opens is included and a knob 4 protruding from the second window portion 2*b* is provided on the upper surface of the slider portion 3 and three sheet-like print surface retainer portions 5, 6, 7 are located side by side along the lower side of the slider portion 3. As shown in FIG. 3, fixed to the lower surfaces of the print surface retainer portion 5, 6, 7 are print surface portions 8, 9, 10 respectively, each comprised of a thermoplastic expanded sheet or the like impregnated with ink of a different color. Further, the slider portion 3 and each print surface portion 5, 6, 7 are coupled by means of two resilient hinge portions 11, 11, and the slider portion 3, three print surface retainer portions 5, 6, 7 and the resilient hinge portions 11 are all integrally formed with a material such as resin or the like. As shown in FIG. 4A, three print surface retainer portions 5, 6, 7 lie flush with each other in the non-depressed condition with their end portions each opposite to the resilient hinge portions 11, 11 disposed upward from the printed surface (such as paper). If the print surface retainer portions 5 are depressed from above by hand, as shown in FIG. 4B, the print surface retainer portions 5 are rotated within the plane perpendicular to the printed surface 12 so that the print surface portions 5 may be depressed against the printed surface 12.

As shown in FIG. 3, within the frame 2, a guide bar 13 (guide portion) is fixed, extending in the longitudinal direction of the frame 2. This guide bar 13 passes longitudinally through the interior of the slider portion 3 to serve to guide the direction in which the slider portion 3 longitudinally moves in parallel within the frame 2. Further, three grooves 13*a* (recesses: means for registering the printing positions) cut in the radial direction of the bar are provided on the guide bar 13, and a spring 14 (means for registering printing positions) having a protrusion 14*a* (convex portion) large enough to fit into the groove 13*a* of the guide bar 13 is fixed at the lower portion of the slider portion 3. Therefore, if the slider portion 3 is moved in parallel to and along the guide bar 13, when the protrusion 14*a* of the spring 14 is positioned to the groove 13*a* of the guide bar 13, the protrusion 14*a* fits into the groove 13*a* to suppress the movement of the slider portion 3 with the result that the position where the slider portion 3 stops is determined by three points. The pitch between grooves 13*a* is identical to that between each print surface portion 8, 9, 10, and the slider portion 3 stops when each print surface retainer portion 5, 6, 7 is positioned below a first window portion 2*a*. When one wants to move the slider portion 3 again from the stopping position, if he applies a force to it in the horizontal direction, then the protrusion 14*a* is released out of the groove 13*a*, and with the protrusion 14*a* sliding along the surface of the guide bar 13, the slider portion 3 will move.

Next, how to use the overprint stamper 1 having the foregoing arrangement is described.

Figure 5A:
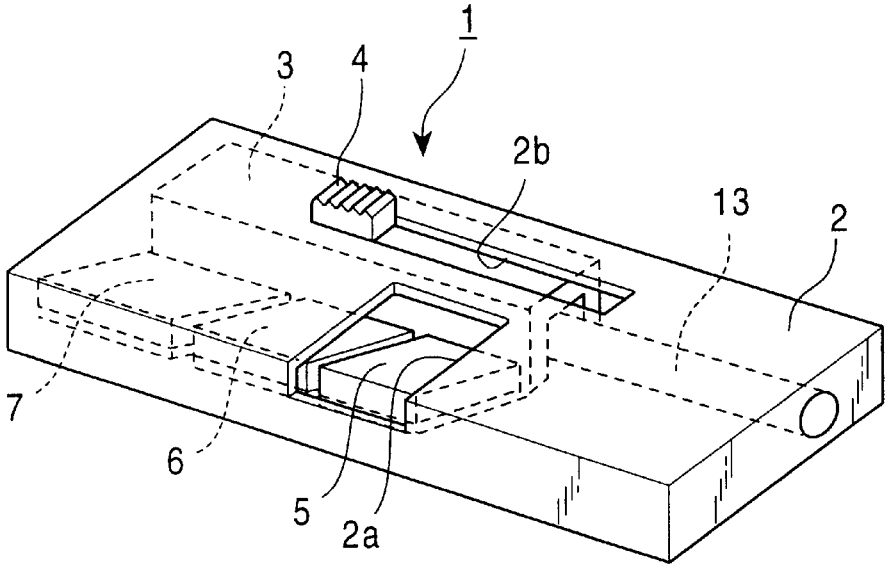
FIG. 5A is a view showing a slider portion of an overprint stamper of the preferred embodiment of the present invention in a state in which it stops at a first position.
Figure 5B:
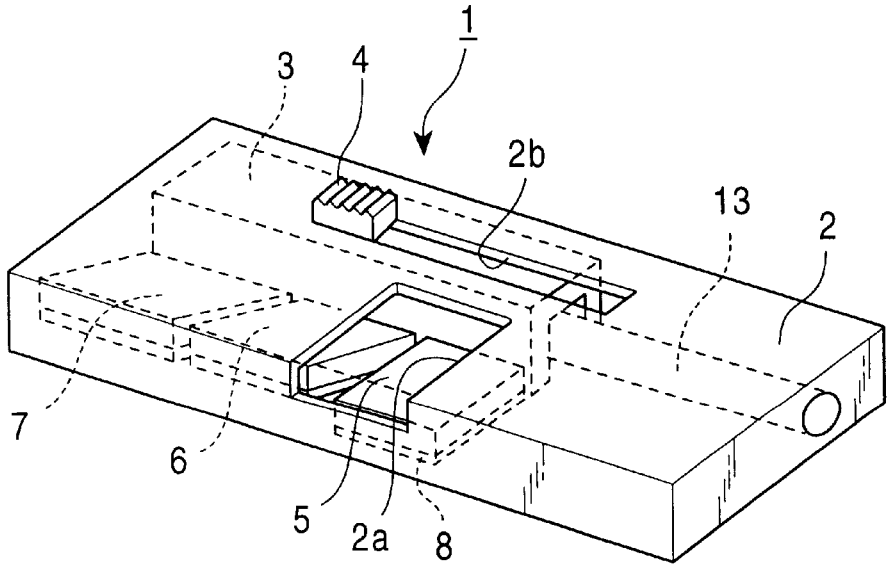
FIG. 5B is a view showing a slider portion of an overprint stamper of the preferred embodiment of the present invention in the depressed state in which it stops at a first position.
Figure 6A:
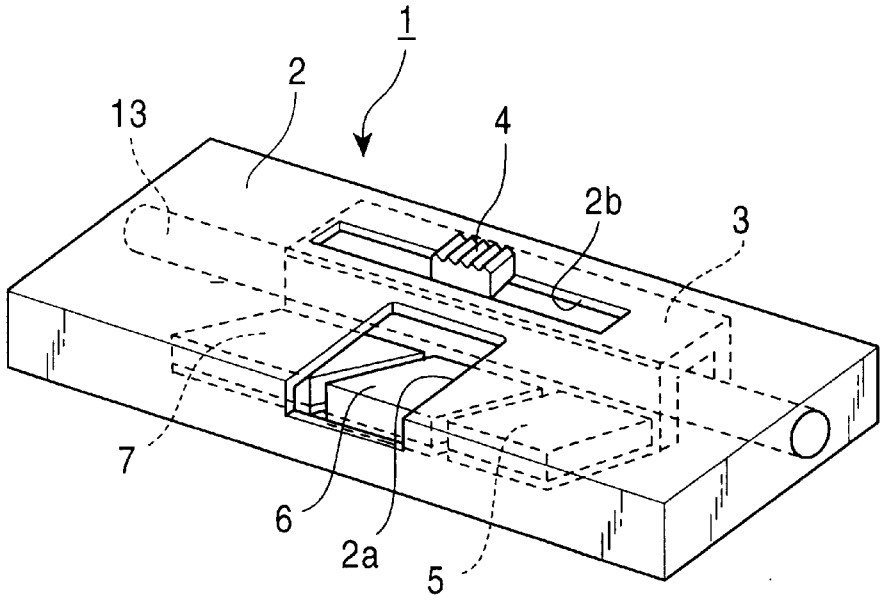
FIG. 6A is a view showing a slider portion of an overprint stamper of the preferred embodiment of the present invention in a state in which it stops at a second position.
Figure 6B:
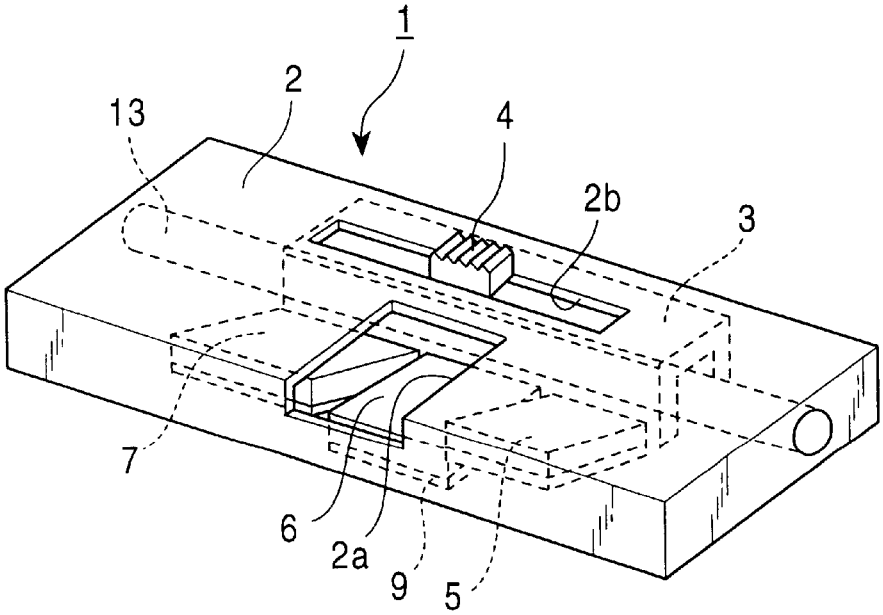
FIG. 6B is a view showing a slider portion of an overprint stamper of the preferred embodiment of the present invention in the depressed state in which it stops at a second position.
Figure 7A:
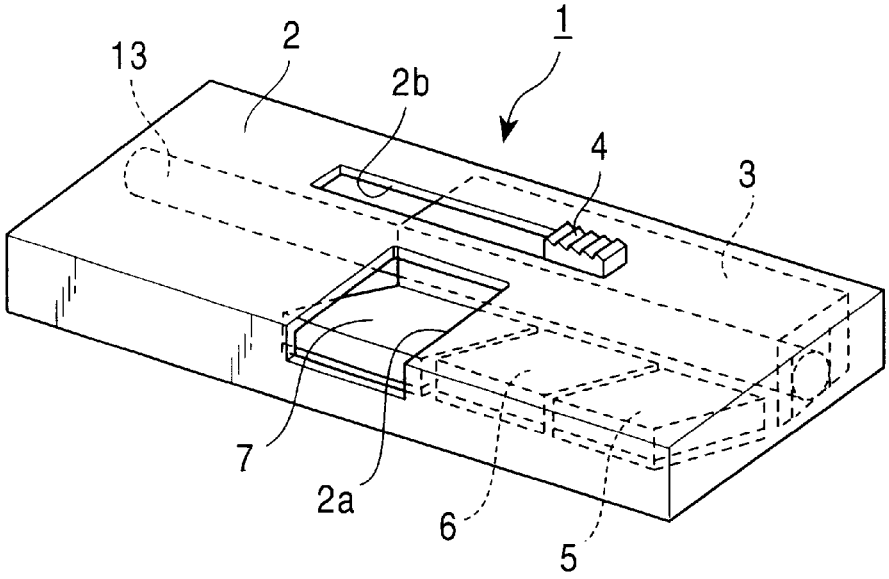
FIG. 7A is a view showing a slider portion of an overprint stamper of the preferred embodiment of the present invention in a state in which it stops at a third position.

As shown in FIG. 5A, when the knob 4 lies at the left side of the second window portion 2*b* and the slider portion 3 lies at the first stopping position, as viewed in FIG. 5A, the first print surface retainer portion 5 is positioned below the first window portion 2*a*, and this print surface retainer portion 5 alone is in the depressible condition. Here, if one depresses the first print surface retainer portion 5, then, as shown in FIG. 5B, only the first print surface retainer portion 5 is rotated, and the printed surface portion 8 is depressed by the print surface to achieve a first printing stroke. Next, as shown in FIG. 6A, if the knob 4 is made to slide to the right until it moves to the center of the second window portion 2*b*, then, the slider portion 3 stops at the second and central stopping position. At this time, the second print surface retainer portion 6 is positioned below the first window portion 2*a*, and only this print surface retainer portion comes into a depressible condition. Here, if the second print surface retainer portion 6 is depressed, then, as shown in FIG. 6B, only the second print surface retainer portion 6 is rotated, and the print surface portion 9 is depressed against the printed surface to achieve a second printing stroke. Likewise, as shown in FIG. 7A, if the knob 4 is further made to slide to the right until it comes to the right of the second window portion 2*b*, then, the slider portion 3 stops at a third and rightmost position. At this time, only the third print surface retainer portion 7 comes into a depressible condition. Here, if the third print surface retainer portion 7 is depressed, then, as shown in FIG. 7B, only the third print surface retainer portion 7 is rotated, and the print surface portion 10 is depressed against the printed surface to achieve a third printing stroke.

Figure 7B:
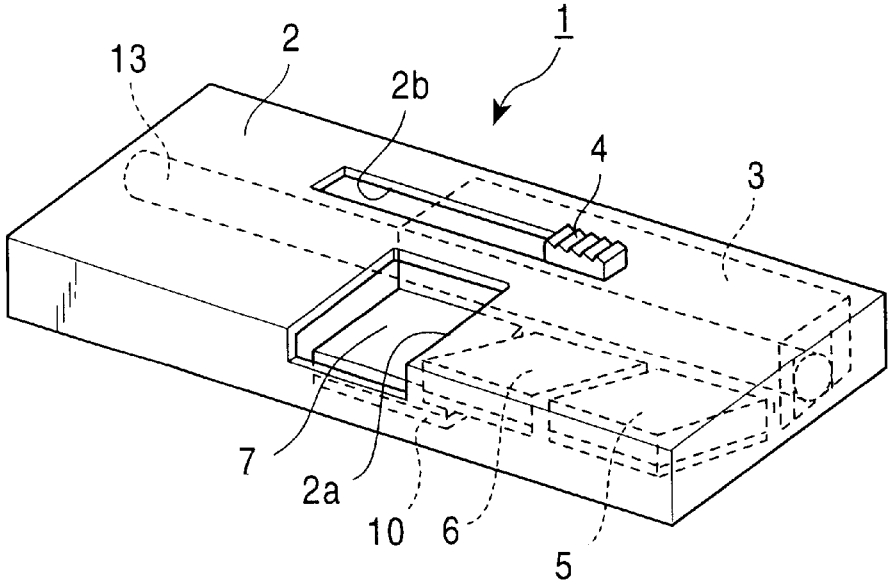
FIG. 7B is a view showing a slider portion of an overprint stamper of the preferred embodiment of the present invention in the depressed state in which it stops at a third position.

As described above, when the print surface retainer portions 5, 6, 7 positioned at the first window portion 2*a* of the frame 2 is depressed three times at three positions where the slider portion 3 temporarily stops (the positions in FIGS. 5A, 6A and 7A), each print surface retainer portion 5, 6, 7 operates as shown in FIGS. 5B, 6B and 7B, and three print surfaces are overprinted at the same position of the printed surface to achieve a full color print.

Next, a method of making the overprint stamper, and in particular, a method of processing the print surface according to this embodiment is described with reference to FIG. 8. Incidentally, this method relates to a thermal engraving method, which is one of the methods of processing the print surface of the penetrant ink type general-purpose stamper.

First, a penetrant ink type stamping material taking the shape of a planar sheet is fixed to the lower surface of the three print surface retainer portions 5, 6, 7 which are integrally formed with the slider portion 3 by means of the resilient hinge means. Here, as the stamper material, a thermoplastic expanded sheet having open cells is used.

Figure 8A:
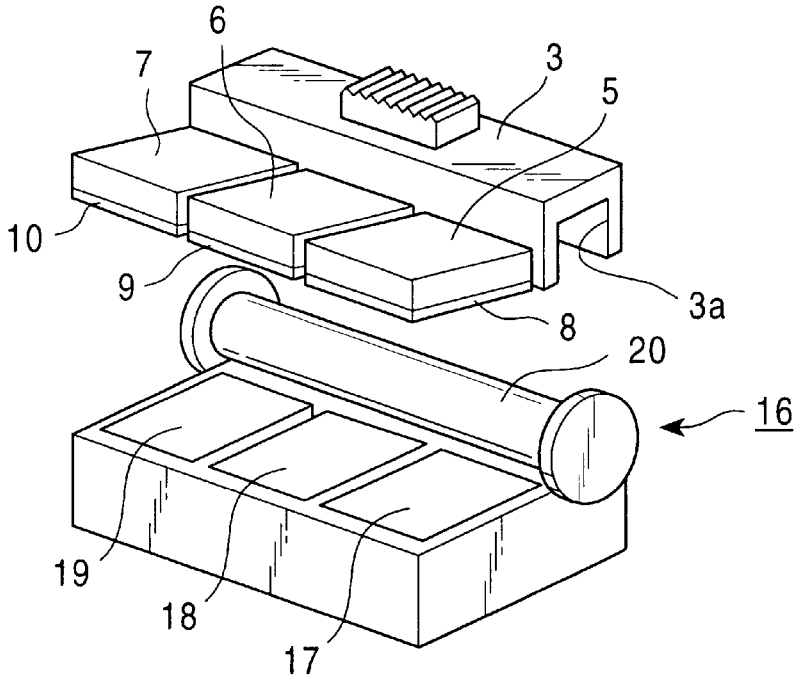
FIG. 8A is an illustration of a method for processing a stamp printing surface of an overprint stamper of the preferred embodiment in addition to a view showing a state before the slider portion is set at a printing surface processing machine.
Figure 8B:
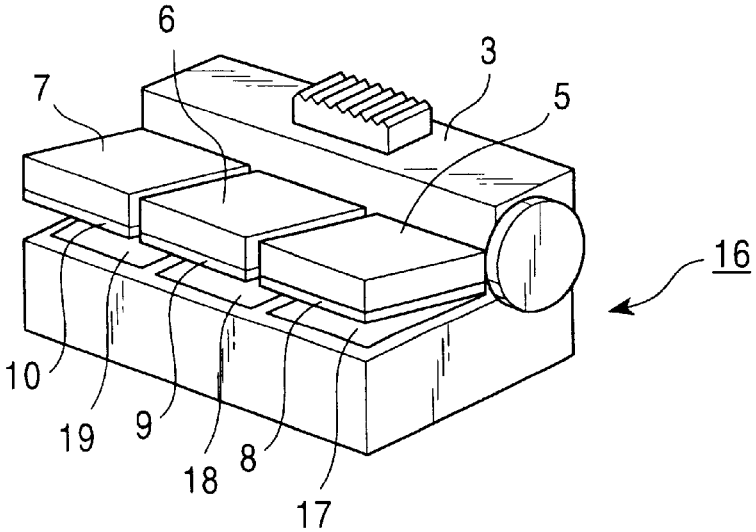
FIG. 8B is an illustration of a method for processing a stamp printing surface of an overprint stamper of the preferred embodiment in addition to a view showing a state after the slider portion is set at a printing surface processing machine.

Reference numeral 16 of FIG. 8A denotes a print surface processing machine. The print surface processing machine has engraved surfaces 17, 18, 19 of a thermal sheet on which three kinds of print surface patterns are engraved while having a bar guide portion 20 for processing the print surface to register the print surface of the stamper. This guide portion 20 is sized to be insertible into the groove 3*a* of the slider portion 3 into which the guide bar 13 of the stamper 1 is inserted. As shown in FIG. 8B, the slider portion 3 is fixed on the print surface processing machine in such a way that the groove 3*a* of the slider portion 3 and the guiding portion 20 are fitted into each other. Here, if three print surface retainer portions 5, 6, 7 are simultaneously depressed against the engraved surfaces 17, 18, 19, then the patterns of the engraved surfaces 17, 18, 19 are simultaneously transferred onto the printed surfaces 8, 9 and 10, respectively.

As described above, in the overprint stamper 1 according to this embodiment, the print surface retainer portions 5, 6, 7 are formed flush with each other to achieve simultaneous processing relative to the three print surface portions 8, 9, 10. As a result, unlike conventional methods of processing the print surface, which are generally adopted for the penetrant ink type stamper having a thermoplastic expanded sheet including open cells, the positional misregistration of the print surface patterns, which has been inherent to the prior art, can be decreased using the print surface process of the present invention. Further, since three print surface retainer portions 5, 6, 7 are supported by means of the slider portion 3, which in turn is made to move in parallel to and along the guide bar 13, the accuracy of the slider portion movement may be improved. In addition, since the means for registering the printing positions is provided to control the position where the slider portion 3 stops by means of the grooves 13*a* of the guide bar 13 and the spring 14 of the slider portion 3, the accuracy of registering the print surfaces becomes substantially the same as that of processing the grooves of the guide bar 13 to lessen the positional misregistration.

Further, since the slider portion 3 and the point surface retainer portions 5, 6, 7 are coupled by means of the resilient hinge portion 11 to rotate each print surface retainer portions 5, 6, 7 when depressed, the misregistration caused by the pressure variation can be made small.

Three factors contribute to printing deviation. These factors are: the misregistration of the patterns of print surfaces when they are processed, the positional misregistration when the position of the print surface is determined, and the misregistration caused when the print surface is depressed.

But, in contrast, in the overprint stamper 1 of this embodiment, since all the factors of pattern misregistration, positional misregistration and the pressure variation can be each lessened, the printing deviation can be remarkably lessened as compared with that of the prior art.

In the overprint stamper 1 according to this embodiment, since the number of the used parts is small and the number of checkpoints for the accuracy of working each part is lessened, the plural print surfaces can be overprinted with high accuracy with a simple construction. As a result, the full color stamp can be inexpensively provided.

Incidentally, the technical scope of the present invention is not necessarily restricted to the foregoing embodiment, but various changes and modifications may be added within the scope, which does not fall beyond the effect of the present invention. For example, although the foregoing embodiment was described with reference to the three print surfaces each having a different color, a multicolor overprint stamper such as having two print surfaces each having a different color or four print surfaces each having a different color may also be realized. Further, although the resilient hinge means was arranged by molding [all] the slider portion, print surface retainer portion and the resilient hinge portion integrally so that the print surface retainer portion rotates, alternatively, the resilient hinge portion may be substituted with another leaf spring, which couples the slider portion and the print surface retainer portion, or a hinge means in which the print surface retainer portion moves in parallel may appropriately be adopted, as necessary. Still further, as the means for registering the printed positions, any appropriate alternative means may be used other than the grooves of the guide portion and the spring having a protrusion which are used in the foregoing embodiment.

Referring to the method of processing the print surface, as described with reference to the foregoing embodiment, various methods may be used including not only the method of forming the print surface with the heated engraved surface, but also the method of forming the print surface by selectively applying heat rays, the method of forming the print surface by using a thermal head or the like. Further, not only the method of impregnating the print surface after formed with ink, but also the method of working the print surface after the print surface portion is previously impregnated with ink may be adopted.

As described above in detail, the overprint stamper according to the present invention, a plurality of print surfaces is formed flush with each other for the penetrant ink type stamper, which allows various methods of processing the print surface to be adopted without requiring any additional investment while, at the same time, allowing a plurality of print surface patterns to be processed within the pattern accuracy translated in terms of a single print surface. As a result, the print pattern misregistration is remarkably improved and the full color printing can be realized. Further, since the number of used parts is small and only the accuracy of the registering means, which controls the stopping position of the slider portion, may be controlled, the color stamper can be provided inexpensively. Still further, in this overprint stamper, if the operation of moving the slider portion or the operation of depressing the print surface retainer portion is conducted by, for example, the motor-driven system in place of manual drive, then the color stamper may also be automated.

What is claimed is:

1. An overprint stamper, comprising:

a plurality of print surface retainer portions positioned flush with each other in a non-depressed condition;

a plurality of print surface portions each fixed to said plurality of print surface retainer portions, respectively;

a slider portion depressibly supporting said plurality of print surface retainer portions in juxtaposition while being generally movable in a direction in which said plurality of print surface retainer portions are juxtaposed;

a guide portion guiding the direction in which said slider portion moves;

recess portions provided at said guide portion; and a spring having a convex portion fitting into said recess portion, said spring provided at said slider portion and to control a position where said slider portion stops on said guide portion such that that each of said plurality of print surface retainer portions is positioned at a predetermined printing position.

2. An overprint stamper as set forth in claim 1 wherein said slider portion and said plurality of print surface retainer portions are unitarily molded and said plurality of print surface retainer portions rotatable supported on said slider portion such that said plurality of print surface retainer portions are rotatable within a plane perpendicular to a printed surface.

3. A method of overprint stamping, comprising:

providing a print surface comprised of a thermoplastic expanded sheet having open cells;

providing a plurality of print surface retainer portions positioned flush with each other in a non-depressed condition;

uniquely fixing one of a plurality of print surface portions to one of said plurality of print surface retainer portions;

depressibly supporting said plurality of print surface retainer portions on a slider portion, said slider portion being movable in a direction substantially planar with said print surface;

guiding a direction of motion of said slider portion via a guide portion;

controlling a stopping position of said slider portion on said guide portion such that each of said plurality of print surface retainer portions is positioned at a predetermined printing position, said stopping position being controlled by recess portions provided on said guide portion and a spring provided on said slider portion and having a convex portion fitting into said recess portion; and applying said plurality of print surface portions to said print surface using a heated deformation process.

4. The method of overprint stamping of claim 3 further comprising:

unitarily molding said slider portion and said plurality of print surface retainer portions; and rotatably supporting said plurality of print surface retainer portions on said slider portion such that said plurality of print surface retainer portions are rotatable in a plane perpendicular to the print surface.

* * * * *

UNITED STATES PATENT AND TRADEMARK OFFICE

CERTIFICATE OF CORRECTION

PATENT NO. : 6,098,541

DATED : August 8, 2000

INVENTOR(S) : Hiroyasu Miyata

It is certified that error appears in the above-identified patent and that said Letters Patent is hereby corrected as shown below:

Under Section "[73] Assignee:" after "Alsp Electric Co., Ltd., insert

-- Tokyo, Japan and Tetsuyuki Toyama, Aichi-ken, --.

Claim 1, Col. 7, line 31, delete "that" (second occurrence).

Claim 2, Col. 7, line 37, change "rotatable" to -- rotatably --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*